United States Patent [19]

Tetschner

[11] Patent Number: 4,683,692

[45] Date of Patent: Aug. 4, 1987

[54] INSULATION STRIP

[76] Inventor: Allen Tetschner, 622 E. Loucks St., Sheridan, Wyo. 82801

[21] Appl. No.: 730,104

[22] Filed: May 3, 1985

[51] Int. Cl.[4] ..... E04B 1/78

[52] U.S. Cl. ..... 52/169.11; 52/202; 52/406; 52/745

[58] Field of Search ..... 52/169.11, 741, 743, 52/745, 169.1, 404, 406, 202, 201

[56] References Cited

U.S. PATENT DOCUMENTS

| | | | |
|---|---|---|---|
| 4,265,062 | 5/1981 | Klibofske | 52/169.11 |
| 4,425,744 | 1/1984 | Villareal | 52/202 |
| 4,458,450 | 7/1984 | Battle | 52/169.1 |
| 4,516,374 | 5/1985 | Finney | 52/404 |

FOREIGN PATENT DOCUMENTS

| | | | |
|---|---|---|---|
| 601796 | 7/1960 | Canada | 52/201 |
| 18006 | 10/1980 | European Pat. Off. | 52/406 |
| 2233058 | 1/1974 | Fed. Rep. of Germany | 52/406 |
| 3032867 | 4/1982 | Fed. Rep. of Germany | 52/404 |
| 1392443 | 2/1965 | France | 52/404 |
| 444507 | 6/1949 | Italy | 52/464 |
| 73653 | 11/1953 | Netherlands | 52/404 |

*Primary Examiner*—William F. Pate, III
*Assistant Examiner*—Caroline D. Dennison
*Attorney, Agent, or Firm*—Paul H. Gallagher

[57] ABSTRACT

The device includes a shell with a mat of insulation material therein, held by friction. The shell is secured to a building, in position extending across a juncture line where a hole or gap exists. It has a mounting strip at the top edge, which also serves as a wheather protector. In one form the shell is made of wood, and includes a mounting timber at the top having an inclined edge engaging the building and thereby biasing the lower portion against the building, eliminating the need for securement of the device at the lower location. In another form the shell is made of metal.

4 Claims, 5 Drawing Figures

INSULATION STRIP

FIELD OF THE INVENTION

The invention relates to applying insulation to existing buildings, for closing holes or gaps that may be the result of deterioration or poor design. It further relates to providing such insulation incorporated in panels, or in pre-cut pieces in a kit to readily form panels, that can be easily applied to a building by the homeowner or a handy man.

OBJECTS OF THE INVENTION

A broad object of the invention is to provide insulation incorporated in pre-fabricated panels, or panel kits, of novel form.

A more specific object is to provide such panels, both pre-fabricated panels and those assembled from kits, that can be easily applied to a building having siding or surfacing elements, without impairing the siding and even utilizing the siding in retaining the panels in place after they are applied.

DESCRIPTION OF CERTAIN PREFERRED EMBODIMENTS

Figure 1:
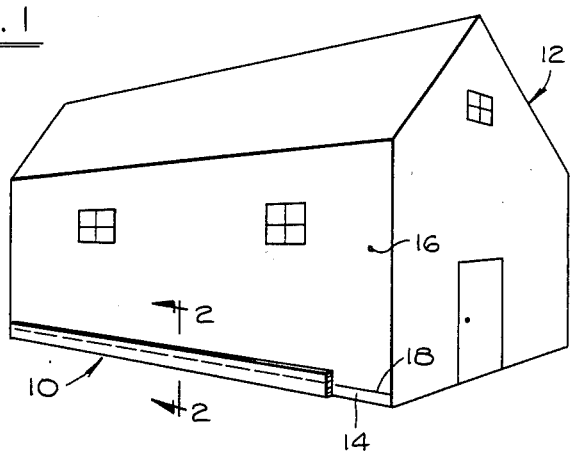
FIG. 1 is a perspective view showing the insulation strip of the invention, applied to a building, showing the environment of the device in use.

Referring in detail to the drawings, the insulation strip of the invention is indicated in its entirety at 10, and attention is directed to FIG. 1 illustrating a building 12 to which the insulation strip is applied, this figure showing the environment in which the insulation strip is best used. Many times, because of deterioration or improper pre-design, there often are holes or gaps in a building. Such a situation often occurs at the foundation on which the wall of the building rests. For convenience, the structure above the foundation may be referred to as the main building. In FIG. 1 the foundation is indicated at 14, and the wall of the main building at 16, this figure including a line 18 indicating the juncture of the foundation and wall, where a gap often occurs. This detail of construction of the building will be referred to in detail hereinbelow. The insulation strip 10 is applied to the building in position extending along that juncture line 18 and covering it. The foundation and main building have what may be referred to as a common wall surface.

Figure 2:
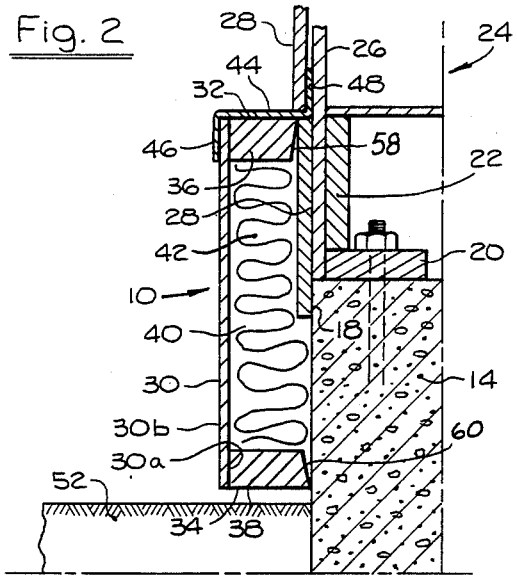
FIG. 2 is a sectional view on an enlarged scale taken at line 2—2, of FIG. 1.
Figure 3:
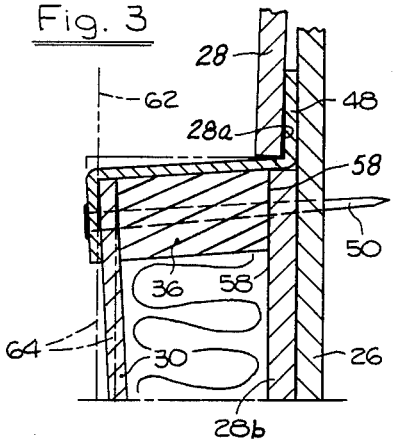
FIG. 3 is a large scale sectional view of the upper portion of FIG. 2.
Figure 5:
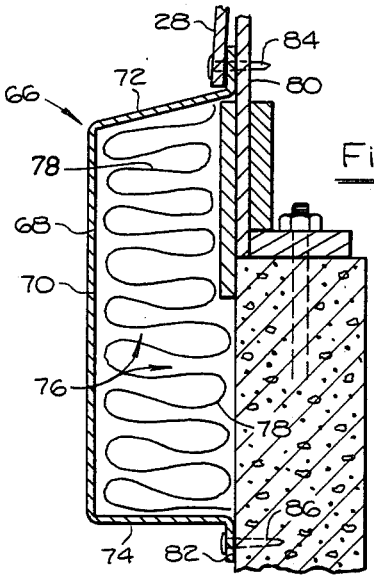
FIG. 5 is a view similar to FIG. 2, showing a modified form of insulation strip.
Figure 4:
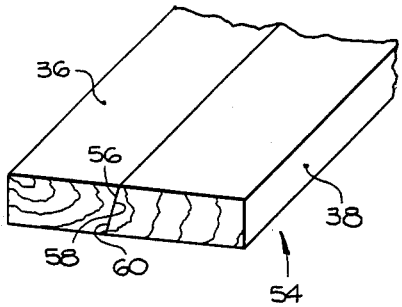
FIG. 4 is a perspective view of a timber and indicating the method of cutting it for producing elements of the insulation strip.

It is pointed out that the insulation strip of the invention is disclosed herein in two forms, or embodiments, one, that of FIGS. 2–4 incorporating a wood construction, and that of FIG. 5 incorporating a sheet metal component.

Referring in detail to the embodiment of FIGS. 2–4, attention is directed first to the elements of the building construction; the foundation 14 includes the usual concrete wall on which a sill 20 is located, and a header 22 on the sill. The wall of the main building includes a suitable construction indicated diagrammatically at 24 which includes a sheathing 26 and outer siding 28. The wall structure as above referred to is of known kind.

The insulation strip 10 includes an outer member 30 of suitable material, such as for example hardboard of $\frac{1}{4}''$ in thickness. For convenience the outer member 30 is referred to as having an inner surface 30*a* and an outer surface 30*b*.

The insulation strip is elongated, according to the expected length of the parting line 18, or other corresponding dimension of the building. The insulation strip may be referred to as oriented as so applied, and as so oriented, has an upper side edge 32 and a lower side edge 34.

Secured to the outer member 30, on the inner surface thereof, closely adjacent the side edges thereof, by suitable means such as screws, nails, etc. are upper and lower side elements 36,38. These side elements are formed as referred to hereinbelow, and may be of different depths, i.e., of different dimensions perpendicular to the outer member 30. The outer member 30 and upper and lower side elements 36, 38, together constitute a shell or casing.

The side elements 36,38, together with the outer member 30 form a recess 40, having a depth direction perpendicular to the outer member 30, this recess having its open side facing the surface of the building, when the insulation strip is applied thereto.

A unit or mat of insulation material 42, of known kind, is positioned in the recess. This insulation material is yieldable, and expandable or resilient at least in vertical direction. The unit of insulation 42 in normal position, has a predetermined dimension, in vertical direction as viewed in FIG. 2, that is greater than the space between the side elements 36,38, and in placing it in the recess, it is compressed so as to fit therein, and upon its release, it expands against the side elements 36,38, and is held therein by friction with those elements.

Incorporated in the insulation strip 10, at the upper edge thereof, is a flashing strip 44 which preferably is of sheet metal, and is secured to the upper side element by suitable means, and has an outer edge portion 46 bent down over the edge of the outer member 30, and another edge portion 48 turned upwardly.

The insulation strip thus described, forms a unitary item, that is handled as such an item, and can be applied to the building by merely fitting it against the building and securing it thereto.

In applying the insulation strip to the building, it is positioned so as to extend vertically across the juncture line 18 between the main building wall and the foundation. The insulation strip may be of any desired width, i.e., vertical dimension, according to circumstances, and may be 12", 16", 24", etc.

In mounting the insulation strip to the building, a board or piece or strip of the siding 28, indicated at 28*a*, is lifted out at the bottom, and the flange element 48 of the flashing is inserted thereunder (see particularly FIG. 3) and the insulation strip is secured in place by utilizing spikes or barn nails 50 which are driven through the upper side element 36. The siding strip 28*a* may also then be re-nailed in place. Preferably the insulation strip is positioned so that the upper edge thereof extends above the lowermost piece 28*b* of siding 28, and thus the strip 48 of the flashing extends under an upper piece (28*a*) of that siding. Accordingly the unit or mat of insulation 42 extends vertically across the juncture line 18 (FIG. 2) which is the most vulnerable spot in the wall construction. Thus this juncture line is completely covered, and effectively sealed.

The insulation strip 10 may be of selected dimension, vertically, as noted above, and in this connection, it may be positioned with its lower side edge at or closely adjacent the ground, indicated at 52, as desired. This positioning of the lower side edge of the strip is not critical. It is pointed out that various elements represented in FIGS. 2 and 3 are exaggerated, and particularly for example the spacing between the siding and the sheathing. (FIG. 3)

The structure of the insulation strip 10 illustrated in FIGS. 2–4 also includes a novel feature of mounting it on the building structure, and in connection with this feature attention is directed first to FIG. 4 which shows a wooden plank 54 which may, for example, be a 2"×6". Such a plank of this size and other sizes are often referred to as "2 by's" or "2 x's". The plank 54 is ripped or cut lengthwise for forming the side elements, identified above and indicated at 36,38. The plank is cut at an angle, indicated by the line 56, that is, inclined relative to the side edges of the plank, forming inclined surfaces 58,60, of the respective elements, 36,38. The inclined surface 58 on the element 36 is utilized for positioning the upper element 36 (FIG. 3) in a certain way in mounting the device. In FIG. 3, the inclined edge 58 is fitted flat against the adjacent siding element 28*b* and the element 36 is thereby inclined downwardly and outwardly. The vertical dot-dash line 62 represents a vertical surface parallel with the siding strip 28. The dot-dash lines 64 represent the vertical position of the outer member 30 when parallel with the siding element 28. However, the side element 36, due to the positioning of the surface 58 thereof flat against the siding element 28 positions the outer member 30 somewhat inwardly, biasing the lower portion of the insulation strip 10 against the foundation 14. Accordingly the insulation strip need be secured to the wall only at the upper edge, and its lower edge need not be positively secured but is held in sealing engagement with the wall in the manner mentioned.

The side element 38 as used in the insulation strip, is the same element ripped from the plank, and although it bears an inclined edge surface (60) this surface does not enter into the functioning of the device, but the element is used, notwithstanding that inclined surface, to effectively utilize the material at hand.

The plank 54 is ripped or cut at a position off center, so as to render the elements 36,38 of different dimensions, or widths, as best shown in FIG. 2. Ordinarily the siding of the main building wall extends outwardly beyond the concrete foundation, and with the dimensions of these elements as represented, the outer member 30 is thereby positioned closely adjacent the vertical.

The insulation unit or mat 42 is yieldable, as noted above, and accordingly it yields to accommodate the differences in elements of the surface of the structure, yielding or partially compacting as against the siding element but yielding more fully as against the concrete foundation.

In the form of the invention of FIG. 5, the insulation strip is indicated in its entirety at 66 and instead of including wood structural elements as in the earlier embodiment, it includes an outer casing 68 of sheet metal. The sheet metal is shaped as shown in FIG. 5, having an element 70 corresponding to the outer member 30, and top and bottom elements or walls 72,74. These elements 70, 72, 74 form a cavity 76 in which is an insulation unit or mat 78, dimensioned and held in position by friction, in the same manner as described above. At the marginal outer edges of the top and bottom elements 72,74, are outwardly turned flanges 80,82, for securing directly to the building. In the case of the upper flange 80 it is positioned under a siding piece 28 and secured by suitable nails 84. In this case, of the lower side edge of the insulation strip 66 is positively secured to the foundation, such as by concrete nails 80,86.

The device as represented in FIG. 5 adapts itself readily to a prefabricated unit that may be put out as a complete unit. The construction represented in FIGS. 2, 3, and 4, while it may also be put out in the form of prefabricated units, also adapts itself well to fabrication of the individual elements, which may conveniently be put out in kit form, and which the ultimate user may fit together at the site. It is also feasible to put out plans for the device of FIGS. 2–4, enabling the user himself to obtain the parts and fabricate them and assemble them.

I claim:

1. An insulation strip adapted for application to the surface of a wall having elements extending outwardly from the surface thereof different amounts, thereby forming inner and outer portions considered perpendicular to the wall, the insulation strip when so applied having a position of use on the wall, the insulation strip comprising, a shell having a recess and an open side, and in its said position of use having its open side directed to the wall, the shell including, (a) an outer imperforate member of a width substantially determining a vertical dimension of the strip as oriented in its position of use, and having upper and lower side edges and being of indeterminate length, (b) side elements on an inner surface of the outer member extending along the side edges determining a depth dimension of the recess and thereby the thickness of the strip perpendicular to the wall, wherein, the side elements have substantial dimension in the direction perpendicular to the wall, the side elements are identified as upper and lower side elements corresponding to the respective side edges, and the upper side element having an inner edge engaging the wall that is so inclined that when that side element is forced into tight engagement with the surface of the building in securing the insulation strip to the building, the lower portion of the shell is biased inwardly into engagement with the building, (c) insulation material in the recess, free of mechanical connection to the shell, the insulation material being expandable, with a dimension greater than the recess in vertical direction in the position of use of the strip and thereby held in the recess by friction, and extending substantially the depth of the recess, and yieldable whereby to accommodate and shape to said inner and outer portions of the wall.

2. An insulation strip according to claim 1 wherein, the insulation strip includes a flashing member applied to said upper said edge providing weather protection to the insulation strip and a means for securing the insulation strip to the wall.

3. An insulation strip according to claim 2 for application to a wall having an upper portion above a parting line and a lower portion below the parting line, and wherein the upper portion extends outwardly beyond the lower portion, and in said position of use, the insulation strip covers said parting line, wherein, the upper side element is of less dimension than the lower side element in direction of the depth of the recess, whereby in response to the upper and lower side members engaging said upper and lower portions of the wall, repectively, the outer member is substantially vertical.

4. A method of making an insulation strip that includes an outer member having a pair of side edges and side elements along the side edges, forming a recess therewith, the side elements being adapted to be secured to the wall of a building for securing the strip to the wall, including the step, utilizing a timber equivalent in width to the side elements together in direction of the depth of the recess, and cutting the timber lengthwise at an angle inclined to a side edge of the timber, thereby forming two pieces thereof, and utilizing the pieces as said side elements, with at least one of them being positioned with the surface thereof that was formed by the cutting of the timber directed away from the outer member and positioned in engagement with the surface of the wall, and with the open side of the recess facing against the wall.

* * * * *